United States Patent [19]

Bernhard

[11] Patent Number: 4,726,126

[45] Date of Patent: Feb. 23, 1988

[54] SHOE, PARTICULARLY INTENDED FOR REHABILITATION PURPOSES

[75] Inventor: Constantin Bernhard, Munich, Fed. Rep. of Germany

[73] Assignee: Puma AG Rudolf Dassler Sport, Herzogenaurach, Fed. Rep. of Germany

[21] Appl. No.: 872,733

[22] Filed: Jun. 10, 1986

[30] Foreign Application Priority Data

Jun. 10, 1985 [DE] Fed. Rep. of Germany ..... 3520746

[51] Int. Cl.[4] ..... A43B 7/14; A43B 19/00

[52] U.S. Cl. ..... 36/89; 36/88; 36/71; 36/93

[58] Field of Search ..... 36/88, 89, 93, 95, 96, 36/57–58, 71, 107, 132, 136, 117, 115; 128/80 H, 581

[56] References Cited

U.S. PATENT DOCUMENTS

| | | | |
|---|---|---|---|
| 534,179 | 2/1895 | Sessler | 36/89 |
| 654,388 | 7/1900 | Diemer | 36/136 |
| 1,952,409 | 3/1934 | Berg | 36/136 |
| 2,019,587 | 11/1935 | Tyrrell | 36/136 |
| 2,801,477 | 8/1957 | Adams et al. | 36/136 |
| 4,516,337 | 5/1985 | Adamik | 36/136 |
| 4,523,392 | 6/1985 | Gabrielli | 36/88 |

FOREIGN PATENT DOCUMENTS

| | | | |
|---|---|---|---|
| 820706 | 11/1951 | Fed. Rep. of Germany | 36/119 |
| 1055295 | 2/1954 | France | 36/89 |
| 73643 | 9/1960 | France | 36/117 |
| 359996 | 3/1962 | Switzerland | 36/117 |
| 302862 | 12/1928 | United Kingdom | 36/136 |
| 496056 | 11/1938 | United Kingdom | 36/71 |

*Primary Examiner*—Steven N. Meyers

*Attorney, Agent, or Firm*—Sixbey, Friedman & Leedom

[57] ABSTRACT

A shoe having an upper portion with a slit opening, through which an insert is placed or placeable into the shoe upper between its upper material and the lining portion, specifically intended for the purpose of rehabilitation, which shoe is designed such that it can be better adapted to various types of foot shapes.

The shoe is intended to enable the plaster cast or other support cast, normally necessary in the healing process and employed for foot injuries or foot surgery, to be removed after a short time. This is achieved in preferred embodiments through use of at least one insert 6 of flexible material that has a plate-like configuration. At least one side of insert 6, and a facing inner surface of the shoe upper material coming into contact therewith, has a surface which provides that, at least between these two inner surfaces coming into contact, there is sufficient friction to cause insert 6 to be retained in place during the wearing of the shoe.

26 Claims, 4 Drawing Figures

SHOE, PARTICULARLY INTENDED FOR REHABILITATION PURPOSES

BACKGROUND AND SUMMARY OF THE INVENTION

The present invention relates to a shoe, particularly intended for rehabilitation purposes, having an upper portion with a slit opening through which an insert is or may be placed into the shoe upper.

A comparable shoe designed as a ski boot, is disclosed in Swiss Pat. No. 359,996, wherein, in the upper of the shoe, on both sides behind the ankles, there is formed a vertical pocket or guide member, open at the top, into which displaceable reinforcing stays can be vertically inserted. The openings, respectively, are covered by lateral wing portions which are connected with each other by a back drawstring member which provides stiffening support to the torsal joint and better conformance of the shoe to the foot.

It is a general objective of the present invention to provide a shoe of the type described above, that is designed in such a manner that the shoe can be better adapted to various types of foot shapes. Moreover, it is a particular objective of the invention to enable a plaster cast, or other support cast, employed for foot injury or foot surgery, for instance in cases of intercapsular injury of the ligaments, or of the ankle, to be removed after a short time, or that the need for such a cast can be eliminated altogether.

The above objectives are achieved, in accordance with preferred embodiments of the invention, by utilizing at least one insert of a flexible (resilient) material and plate-like configuration, at least one side of which has a surface that, along with a facing inner surface of the shoe upper material, provides sufficient friction to prevent displacement of the insert while the shoe is worn. Slit openings permit inserts of varying sizes, adapted to the requirements at hand, to be easily inserted between the lining and the upper material of the shoe upper, which inserts do not require additional fastening means while the shoe is worn. Accordingly, no pockets or guide portions, specifically conforming to the inserts are, necessary, and even a single slit opening is sufficient to provide a support for the various portions of the foot, particularly portions of the ankle, with a number of correspondingly adapted inserts.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENTS

Figure 1:
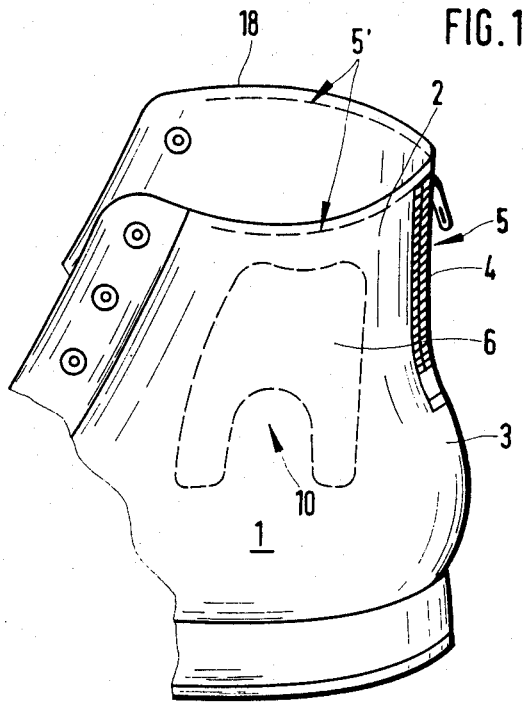
FIG. 1 shows a back portion of a shoe, particularly of a shoe for rehabilitation purposes, in accordance with the invention.

A shoe designed as a boot, particularly suitable for rehabilitation purposes, is designated with numeral 1. This shoe has an upper 2 whose back edgeg has, instead of the usual heel band or vertical seam, a slit opening 5, which can be closed by a zipper closure 4. Alternatively, a hook and pile (Velcro) closure, or a snap closure may be used in place of the zipper closure.

Slit opening 5 is depicted in closed condition. In its open condition an elastically flexible insert 6 can be inserted between the upper material 7 and the inner lining 8.

Figure 3:
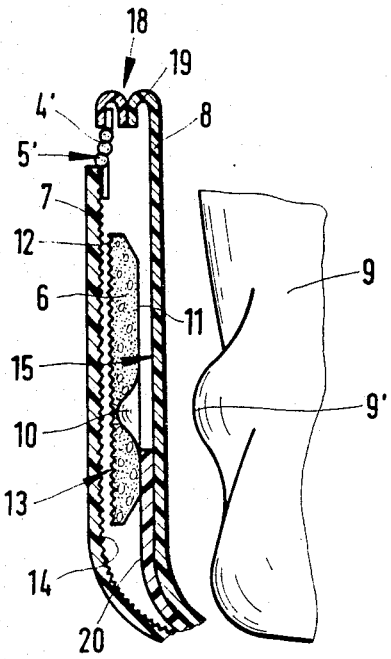
FIG. 3 shows a section through a shoe upper, viewed from the heel forward, depicting a insert within the upper, but spaced from adhering surface and including a portion of the foot in rear view.
Figure 4:
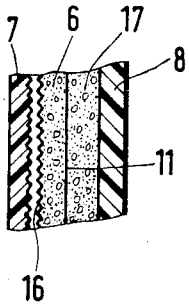
FIG. 4 shows a section of a shoe upper configuration, with an additional lining and an insert in place.

Advantageously, slit opening 5 extends over the entire height of the shoe upper, so that it is relatively large and can accommodate insertion of various forms of large inserts at both sides. FIG. 3 shows a cross section of a shoe upper, whereby for purposes of clearer graphic representation, a space has been shown between the individual elements. FIG. 4 shows such elements in normal position.

Insert 6 consists of a flexible, and, if appropriate, a compressible, and more specifically, a volume-compressible material of plate-like shape to provide good adhesion for the back that is free of hollow spaces between the foot 9 and shoe upper 2, as well as for the deliberate creation of spaces, for instance, in the area of surgical satures, swellings, bruises, or the like.

For a good fit in the area of ankle 9, for example, insert 6 is provided in that area with a cutout or recess 10 which, on the side 11 which faces foot 9 (inner side) is tapered outwardly at edge 12.

Inner side 11 and/or outer side 13 of insert 6, as well as inner surface 14 of upper material 7 contacting it, and/or the inner surface 15 of inside lining 8, are designed such that they provide better adhesion of insert 6 in the shoe upper 2 when the shoe 1 is worn. The provision of a frictional connection facilitates a firm adherance between the upper and insert that practically eliminates the possibility of the insert being displaced. This effect, for example, is the result of roughening the surfaces of the contacting parts, or by providing a corresponding toothed or hooked surface design, thus creating a hook and pile type closure. Alternatively, however, at least one side 11, 13 of insert 6 and/or inner surface 14, 15 of the shoe upper 2 can be coated with a fabric 16, consisting, for example of a polyamide material, like nylon, whose surface has undergone surface roughening. Inner side 11 of support 6, preferably is smooth and can be microporous, if desired.

Instead of, or in addition to the designs of the surfaces described, the materials of insert 6, upper material 7, or of inside lining 8 can be selected so as to provide a substantial amount of friction. This applies particularly when the material used is snythetic or natural rubber, or another elastomeric material, as for example, the synthetic material "Neoprene" by DuPont. Such material, preferable, can be a foam material having open pores at the surfaces. In accordance with FIG. 4, a foam material 7 consisting of volume-compressible material can be laminated onto upper material 7 and/or inner lining 8, if desired. Such foam material 17, preferably, is also open-pored.

In accordance with a further development of the invention, a single circumferential opening or a pair of lateral slit openings 5' can be provided running along the upper edge 18 of shoe upper 2. Such slit opening(s)

5' may be closed by a zipper closure 4', FIG. 3, either positioned at the exterior surface of the upper 2 (as shown) or extending along top edge seam 19, or alternatively, they can be closed by other suitable means. For example, in place of a zipper closure, there can be especially provided a hook and pile closure, or possible a snap closure or the like FIG. 3 shows a heel counter 20 which extends below ankle 9'.

Figure 2:
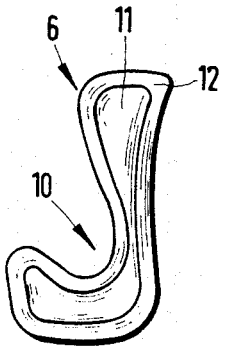
FIG. 2 shows an insert form for use in the shoe of FIG. 1.

Supports 6 may have a different configuration from the one depicted in FIG. 2, with particular consideration given to U-shaped inserts 6' for the ankle portion, which inserts enclose the ankle with U-shaped pieces, as is indicated by a dash line in FIG. 1.

In contrast to the inserts described in Swiss Pat. No. 359 996 inserts 6 are flexible elements, which can be additionally secured by the provision of shoe lacing. Flexible inserts 6 thus basically cooperate with movements of the joints, particularly those of the heel joint, without such movements causing irritations in areas of injury or soreness.

As a result of their flexibility, inserts 6 particularly fill anatomical or surgery-caused hollow spaces, instead of creating such spaces, as is the case when employing inflexible reinforcements stays. Such rigid support elements cause considerable irritation in areas of injuries, surgical wounds, and the like.

While I have shown and described various embodiments in accordance with the present inventin, it is understood that the same is not limited thereto, but is susceptible of numerous changes and modifications as known to those skilled n the art, and I, therefore, do not wish to be limited to the details shown and described herein, but intended to cover all such changes and modifications as are encompassed by the scope of the appended claims.

I claim:

1. A shoe for the physical protection of a foot during medical rehabilitation thereof having an upper portoin with at least one slit opening, through which an insert is placeable into a space that is located between material of which the upper portion is formed and a lining for said upper portion, and at least one insert of compressible material that is conformable to the shape of the foot by compression of the insert and that is of a plate-like configuration; wherein at least one side of the insert and a respective inner shoe surface contacting said at least one side have means for producing sufficient frictional contact therebetween to prevent displacement of the insert relative to the inner shoe surface while the shoe is worn.

2. Shoe according to claim 1, wherein an insert is placed in an ankle area and has an at least partially circular cut-out.

3. Shoe according to claim 2, wherein the insert is outwardly tapered at an edge of a side facing the foot.

4. Shoe according to claim 1, wherein the insert is outwardly tapered at an edge of a side facing the foot.

5. Shoe according to claim 4, wherein a foot-facing side of the insert is smooth.

6. Shoe according to claim 5, wherein at least one inner surface of the shoe upper material consists of an open pored synthetic foam material.

7. Shoe according to claim 1, wherein a foot-facing side of the insert is smooth.

8. Shoe according to claim 1, wherein said insert is formed of a material having synthetic elastomeric properties.

9. Shoe according to claim 8, wherein said insert is formed of a microporous rubber.

10. Shoe according to claim 8, wherein said at least one side of the insert is provided with a fabric having a rough outer surface.

11. Shoe according to claim 10, wherein said fabric consists of a polyamide.

12. Shoe according to claim 1, wherein said at least one slit opening extends along an upper edge of the shoe upper.

13. Shoe according to claim 12, wherein said at least one slit opening is a pair of lateral slit openings.

14. Shoe according to claim 12, wherein fastening means for closing the at least one slip opening is provided.

15. Sheo according to claim 14, wherein said fastening means is a zipper closure.

16. Shoe according to claim 1, wherein the means for producing frictional contact comprises a roughened surface on at least an inner surface of the shoe upper material and a roughened surface on at least a facing surface of the at least one insert.

17. Shoe according to claim 1, wherein said space has an area that is substantially larger than said at least one insert for enabling selective insertion of one or more inserts of various shapes and sizes.

18. A shoe having an upper portion with at least one slit opening, through which an insert is placeable into the shoe upper, particularly for rehabilitation purposes, and at least one insert of flexible material and plate-like configuration; wherein at least one side of the insert and a respective inner shoe surface contacting said at least one side have means for producing sufficient frictional contact therebetween to prevent displacement of the insert relative to the inner shoe surface while the shoe is worn, wherein at least one inner surface of shoe upper material consists of an open pored synthetic foam material.

19. Shoe according to claim 18, wherein said insert consists of a material having synthetic elastomeric properties.

20. Shoe according to claim 19, wherein said insert is formed of a microporous rubber.

21. Shoe according to claim 19, wherein the slit opening extends vertically along a back seam at the heel of the shoe.

22. Shoe according to claim 19, wherein said at least one slit opening extends along an upper edge of the shoe upper.

23. Shoe according to claim 22, wherein said at least one slit opening is a pair of lateral slit openings.

24. Shoe according to claim 22, wherein fastening means for closing the at least one slit opening is provided.

25. Shoe according to claim 24, wherein said fastening means is a zipper closure.

26. A shoe having an upper portion with at least one slit opening, through which an insert is placeable into the shoe upper, particularly for rehabilitation purposes, and at least one insert of flexible material and plate-like configuration; wherein at least one side of the insert and a respective inner shoe surface contacting said at least one side have means for producing sufficient frictional contact therebetween to prevent displacement of the insert relative to the inner shoe surface while the shoe is worn, wherein the slit opening extends vertically along a back seam at the heel of the shoe.

* * * * *